United States Patent [19]

Bailey

[11] Patent Number: 5,065,537

[45] Date of Patent: Nov. 19, 1991

[54] CHANGEABLE LETTER SIGN SYSTEM

[75] Inventor: Raymond J. Bailey, Cortez, Fla.

[73] Assignee: Americraft Corporation, Palmetto, Fla.

[21] Appl. No.: 497,358

[22] Filed: Mar. 22, 1990

[51] Int. Cl.[5] ..... G09F 7/02; A47F 13/06

[52] U.S. Cl. ..... 40/618; 40/621; 40/596; 294/65.5; 294/19.1

[58] Field of Search ..... 40/618, 621, 596, 5, 40/611, 600, 614, 575, 576; 294/65.1, 19.1

[56] References Cited

U.S. PATENT DOCUMENTS

| | | | |
|---|---|---|---|
| 767,060 | 8/1904 | Hotchner | 40/618 |
| 1,677,919 | 7/1928 | Hansen | 40/621 |
| 2,493,108 | 1/1950 | Casey | 294/19.1 |
| 2,584,253 | 2/1952 | Braun | 40/618 |
| 2,616,741 | 11/1952 | Ziese | 294/19.1 |
| 2,895,245 | 7/1959 | Spangler . | |
| 2,923,080 | 2/1960 | Spangler . | |
| 2,935,936 | 5/1960 | Woodring et al. | 40/621 |
| 3,228,133 | 1/1966 | Bearmann | 40/621 |
| 3,254,436 | 6/1966 | Bank . | |
| 3,444,638 | 5/1969 | Jahn . | |
| 3,477,159 | 11/1969 | Bank . | |
| 3,531,884 | 10/1970 | Adler | 40/617 |
| 3,673,720 | 7/1972 | Thornton . | |
| 3,675,355 | 7/1972 | Shanok et al. . | |
| 3,742,633 | 7/1973 | Palm | 40/618 |
| 4,140,405 | 2/1979 | Shapiro et al. . | |
| 4,207,697 | 6/1980 | Murphy . | |
| 4,437,362 | 3/1984 | Hurst . | |
| 4,450,640 | 5/1984 | Shapiro et al. . | |
| 4,575,143 | 3/1986 | Nast . | |
| 4,813,729 | 3/1989 | Speckhart . | |

FOREIGN PATENT DOCUMENTS

| | | | |
|---|---|---|---|
| 74902 | 10/1958 | Denmark | 294/65.5 |
| 3538293 | 4/1987 | Fed. Rep. of Germany | 40/600 |
| 346361 | 9/1904 | France | 40/618 |

*Primary Examiner*—Gary L. Smith
*Assistant Examiner*—F. Saether
*Attorney, Agent, or Firm*—Hovey, Williams, Timmons & Collins

[57] ABSTRACT

A changeable letter sign system including a plurality of panels, each bearing a letter, character or other suitable indicia and combinable on an overhead readerboard to display a message thereon, each of the panels having magnetically attractive material carried on the normally front face thereof, in complete contiguous arrangement with the peripheral inner and outer edges of the indicia on the panel, and including a tool having a magnet presenting a pair of feet for engagement with said magnetically attractive material to permit holding of the panels for placement on or removal from suitable retaining means on the wall of the readerboard.

12 Claims, 2 Drawing Sheets

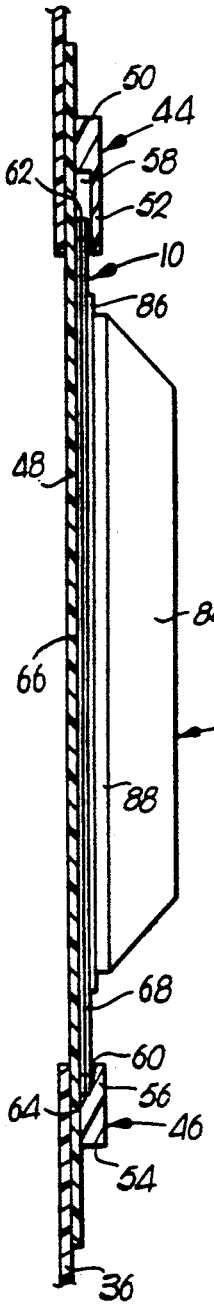
Fig.2.
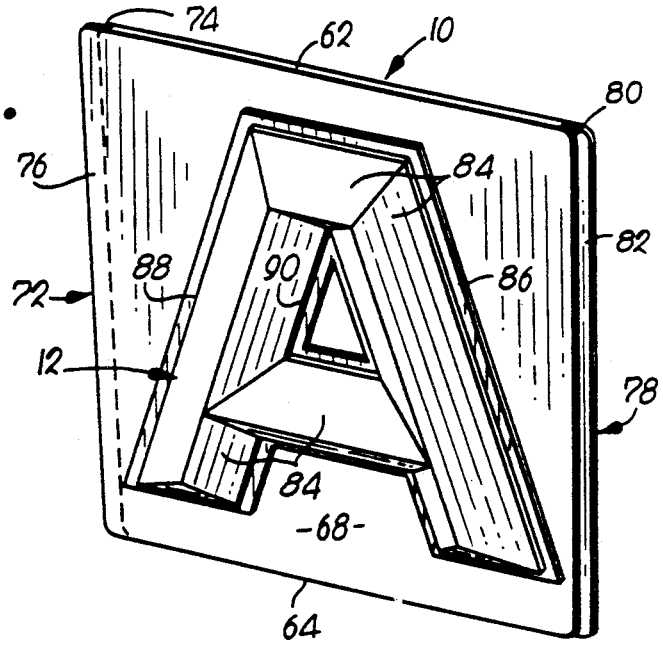
Fig.1.
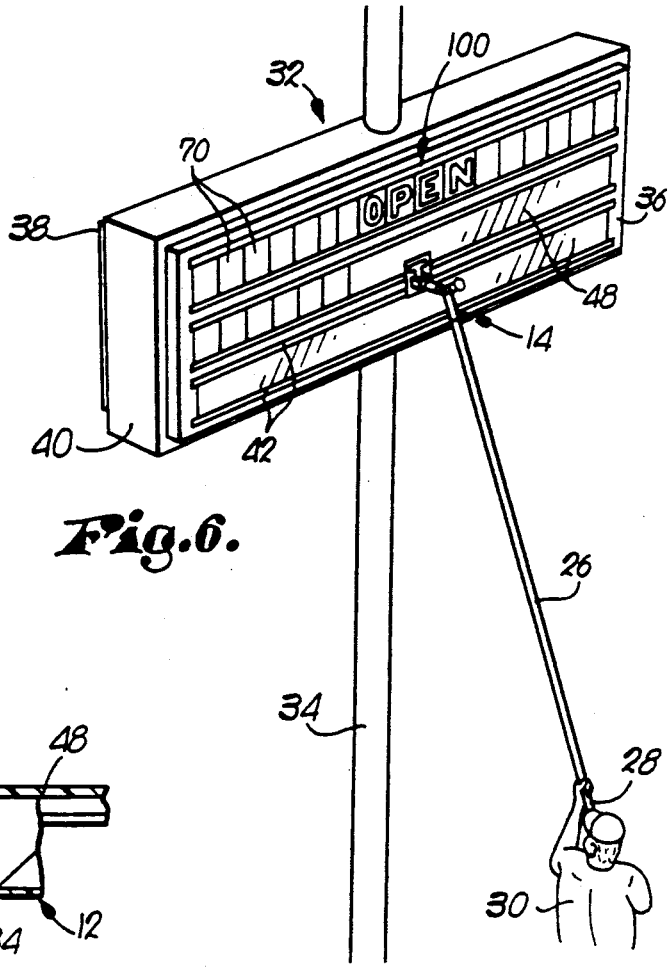
Fig.6.
Fig.5.
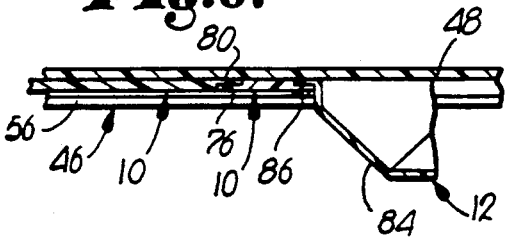

CHANGEABLE LETTER SIGN SYSTEM

BACKGROUND OF THE INVENTION

1. Field of the Invention

This invention relates to a changeable letter sign system for normally overhead, illuminated readerboards, the system including a plurality of panels, each bearing on the front face thereof a letter, number or punctuation character, the panels being combinable to collectively present a message displayed on the readerboard, there being means for retaining the panels with respect to the front wall of the readerboard, each of the panels having magnetically attractive material thereon whereby the individual panels may be positioned and removed by a suitable tool, carrying a magnet. The magnetically attractive material is preferably in the form of a strip positioned on the front face of the letterbearing panel and in contiguous relationship with the peripheral inner and outer edges of the letter, character or number on the panel whereby the magnet, carried by a handle on the end of an extension pole may be brought into engagement with the strip of magnetically attractive material to permit changing of the panels on the readerboard.

2. Description of the Prior Art

Readerboards are normally illuminated signs which are displayed in conjunction with a business enterprise to advertise a feature or function of the business and may be positioned in elevated positions such as for instance on a sign support. It has been known to provide readerboards with transparent walls whereby interior lights may shine therethrough to illuminate letters which are carried on one or both of the transparent, back lit walls of the readerboard.

It has also been known to provide such readerboards and particularly the faces thereof with means for retaining panels which are generally rectangular in plan configuration and of varying widths for self spacing and which panels have a letter, number or other character thereon which is to be displayed on the readerboard, the combination of such panels delivering a message to the viewer of the readerboard.

Such retaining means have taken the form of tracks on the wall of the readerboard which include a pair of spaced apart rails, the rails receiving therein opposed edges of the letter-bearing panel whereby the panel may be inserted in the track either by moving the panel longitudinally of the track for purposes of insertion and placement or by placing one edge of the panel beneath one rail and then swinging the panel to a position where the opposed edge is behind the other rail, resulting in the retention of the panel by the track with respect to the wall of the readerboard.

Normally the panels have been placed with respect to the retaining means either manually or through use of a suction cup used to grasp and position the panel with respect to the wall of the readerboard. Yet further, it has been known to provide the panels with magnets thereon whereby such magnets may be attracted to magnetically attractive material which is formed as a part of the readerboard to thereby retain the panel on the readerboard.

The structure and systems described above are functionally satisfactory, except in the case of three dimensional letters which are carried on a panel, the panels carrying three dimensional letters being difficult to place, particularly on readerboards which are high overhead such as, for instance, on a tall sign support.

SUMMARY OF THE INVENTION

The present changeable letter sign system is particularly intended to be used in connection with letters which are three dimensional in configuration to achieve a multiple color effect and wherein the letter is carried by a panel, which panel is to be placed on a readerboard which is several feet in height above the ground and changing of the panels cannot be readily or economically manually accomplished.

In accordance with the preferred embodiment of this invention, there is provided a letterbearing flat, opaque or translucent panel which has a three dimensional letter formed as a part thereof on the normally front face of the panel, there being magnetically attractive material carried by the panel on the front face thereof.

While the magnetically attractive material could take any configuration and be placed at various locations on the front face of the letterbearing panel, it is preferred that such magnetically attractive material be in the form of a strip which outlines the letter or character on the front of the panel and is, therefore, contiguous with the periphery of a letter, for instance, at both the outer edge thereof and any inner edge which might be presented by a particular letter or number or character.

With the strip of magnetically attractive material so positioned, it is possible to utilize a magnet, carried by a suitable handle, to engage the magnetically attractive material to thereby hold the letter-bearing panel to the magnet so that the panel may be installed and removed by use of the handle with the magnet thereon. It is desirable to provide the handle which carries the magnet with a telescoping extension pole whereby the magnet may be elevated to the height of the readerboard and thus utilized from a remote, lower position to either remove a panel from the retaining means on the readerboard or to position a panel with respect thereto.

To further facilitate the changing of such panels with respect to the retaining means on the wall of the readerboard, which is preferably in the form of a track having spaced apart rails, the magnet is provided with a pair of spaced feet, the spacing between the feet being sufficient to permit the magnet to straddle at least one dimension of the letter or character and thus permit each of the spaced feet to engage a portion of the magnetically attractive strip which is contiguous with the peripheral inner and outer edges of the letter or character.

Through the utilization of such a magnet on an extensible pole, the letter-bearing panels on an overhead readerboard may be readily installed or removed. For instance, to install a panel, the normally upper edge thereof would be slipped beneath the normally uppermost rail of the track; the panel then permitted to move downwardly by gravity and seat the opposed, normally lowermost edge thereof within a channel presented by the normally lowermost rail of the track. The magnet may then be slightly twisted or its position otherwise altered, to break the attraction and thus remove it from the panel. To remove a panel, the magnet, through utilization of the extension pole, is brought into straddling relationship with a portion of the letter to place the magnetic feet in engagement with spaced apart strips, whereupon the panel may be raised to remove the lower edge from the channel of the lower rail, with the lower edge then being swung outwardly and the entire panel moved downwardly to pass the upper edge thereof from beneath the upper rail.

These features and other objects of the invention will become more apparent from a consideration of the following detailed description of the preferred embodiment of my invention when the description is taken in conjunction with the accompanying drawings.

BRIEF DESCRIPTION OF THE DRAWINGS

FIG. 1 is a front perspective view of a letter-bearing panel;

FIG. 2 is a central sectional view through the panel and a portion of the front wall of the readerboard, showing the panel as retained by the rails of the track on the front wall of the readerboard;

FIG. 5 is a fragmentary sectional view showing the manner in which the panels have notches and flanges at their abutting edges to prevent the passage of light therethrough; and FIG. 6 is a perspective view of a readerboard with a user of the system positioning a letter-bearing panel thereon.

DESCRIPTION OF THE PREFERRED EMBODIMENT

Figure 4:
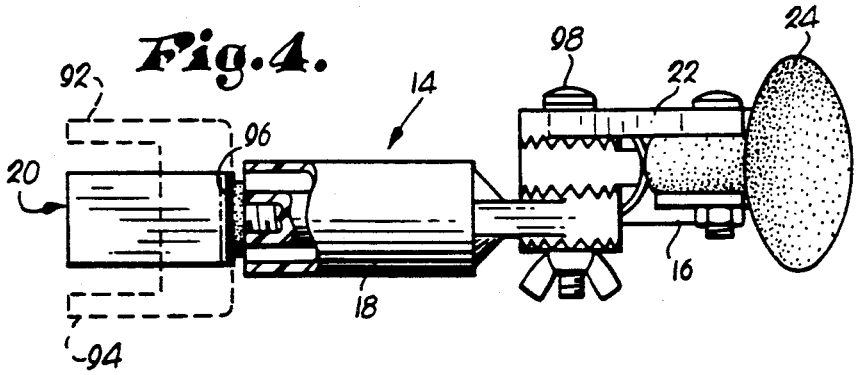
FIG. 4 is a top plan view of the tool as shown in FIG. 3.

The changeable letter sign system broadly includes a panel 10 having a letter, character, number or punctuation thereon, such as, for instance, the letter A, identified as 12 in FIG. 1 of the drawing, and a panel positioning tool broadly designated by the numeral 14. The tool includes a handle 16 having an arm 18 pivotally secured to one end thereof and carrying a magnet 20, there being a link 22 also carried by handle 16 and carrying a suction cup 24 for purposes which will be hereinafter described.

For working with overhead readerboards as shown, for instance, in FIG. 6, the handle 16 may be mounted upon a telescoping extension pole 26, the end 28 thereof which is spaced from handle 16 being operable by a user 30 to install and remove letter-bearing panels 10 in an overhead readerboard 32, which is spaced substantially above the ground supported user 30 by a sign support 34.

In greater detail, the readerboard 32 has a normally front wall 36 which is in spaced opposed relationship to a similar normally rear wall 38, there being a plurality of illuminating means such as light bulbs received within the readerboard between walls 36 and 38 and within a circumscribing casing 40 which retains said walls and completes assembly of the conventional readerboard as illustrated.

On the front wall 36, for instance, there are provided three sets of tracks 42, in the embodiment illustrated, it being appreciated that a similar set of tracks either greater or lesser in number may also be positioned on the opposed rear wall 38 of the readerboard 32. The number of tracks and the positioning thereof on the walls of the readerboard 40 is normally determined by the nature of use of the readerboard and the indicia to be mounted thereon as hereinafter described. Since utilization of the tracks 42 is identical in each instance, the invention will be described in terms of one set of tracks as illustrated, for instance, in FIGS. 2 and 3 of the drawing.

Each set of tracks includes a pair of spaced apart rails 44 and 46, the rail 44 in the embodiment illustrated being the uppermost rail and the rail 46 being the lowermost rail. The rails are secured to a transparent sheet 48 which is a part of the front wall 36 of the readerboard 32, this transparent sheet permitting light from within the readerboard to shine therethrough and thus through any indicia which is carried upon the panel 10 and which is transparent or translucent in nature.

The rail 44 has a base portion 50 which is secured to the sheet 48 and a downwardly extending leg 52 which overlies said sheet 48 of the wall 36.

The normally lowermost rail likewise has a base 54 and an upwardly extending leg 56, the leg 56 of rail 46 being shorter than leg 52 of rail 44. The respective legs 52 and 56 define corresponding channels 58 and 60 which are positioned between the inner portions of said legs and the outer face of wall 36 in the form of sheet 48.

To permit insertion and removal of a panel such as 10 between the rails 44 and 46 of track 42, for instance, the spacing between the bottoms of the channels 58 and 60, defined by bases 50 and 54, respectively, is slightly greater than the vertical transverse dimension of the panel 10.

Figure 3:
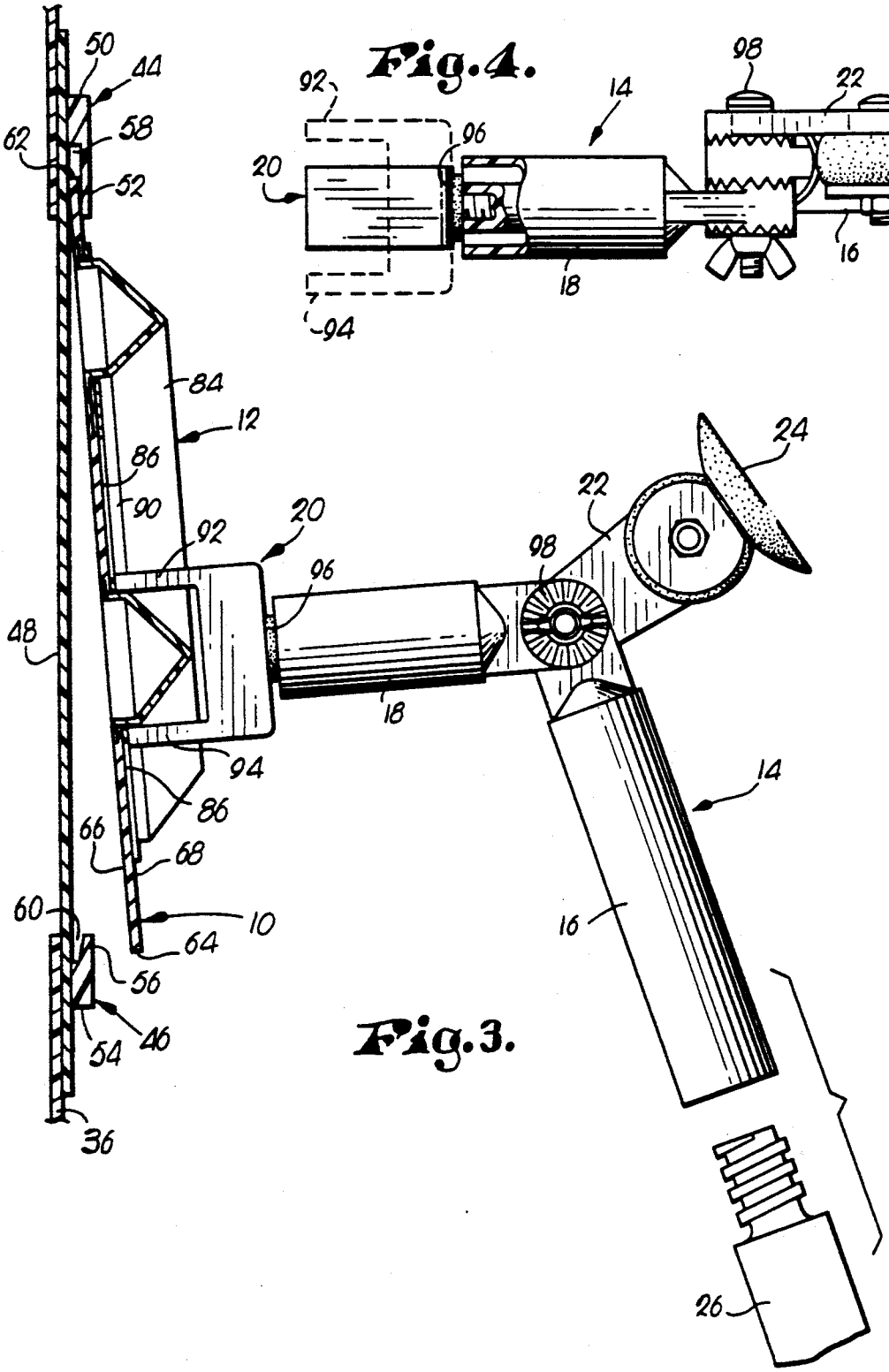
FIG. 3 is a side elevational view of the tool used to place and remove the panel on the readerboard with the panel and the front wall of the readerboard being shown in section and the extension pole which carries the tool being fragmentarily shown.

Thus, viewing FIG. 3, for instance, it will be seen that, to mount a panel such as 10 on the readerboard 32 and particularly front wall 36 thereof and in overlying relationship to sheet 48, the normally uppermost edge 62 of the panel 10 may be initially slid within the channel 58 to raise the panel 10 to a sufficient height that, when it is swung inwardly: that is, toward front wall 36, the normally lowermost edge 64 of the panel 10 will clear leg 60 and thereby permit the rear face 66 of the panel to be brought into parallel, overlying engagement with the sheet 48 and thence to move downwardly under the influence of gravity so that the lower edge 64 of the panel 10 may seat within lowermost channel 60 defined by base 54 and leg 56, whereupon the panel 10 is retained with respect to the front wall 36 of the readerboard, being specifically held in its position as shown in FIG. 2 by leg 52 and leg 56 of the rails 44 and 46, respectively. This permits the letter 12 which is on the front face 68 of the panel 10 to be read by a viewer of the readerboard.

It will be appreciated that a combination of letters, characters and numerals may be utilized to present a message on the readerboard as illustrated, for instance, in FIG. 6. To properly space and present the words of the message when the letters constituting the words do not completely fill the length of a track 42, a number of spacer panels such as 70 may be utilized, the spacer panels being opaque or translucent and preferably of the same color as the front face 68 of letter-bearing panels 10 whereby to match the coloring in the overall sign. The spacer panels, being opaque or translucent, prevent the egress of uncolored light from within the readerboard 32 and thus present an overall attractive appearance for the readerboard.

This is achieved inasmuch as the letters 12 carried by the panels 10 are reverse letters; that is, the material making up the letters themselves is transparent or translucent, whereby light may shine therethrough.

To prevent the passage of light between panels, whether they be spacing panels or indicia panels, one of the side edges 72 of each panel 10 is notched as at 74 to create a laterally extending flange 76 on said side edge 72. The opposite side edge 78 is similarly notched as at 80 to present a corresponding flange 82 on said side edge 78 of the panel 10. Thus, when the panels are abutted, as shown, for instance, in FIG. 5, the flange 76 of a panel 10 will overlay the flange 82 on its next adjacent, abutting panel whereby to prevent the passage of light between the two adjoining panels. Thus, in operation, light will pass only through the translucent panels such as 10 and 70 and through the portions 84 of the letters 12 as shown in FIG. 1, but not from between the panels.

Since the letter-bearing panels 10 may most desirably be used on a readerboard 32 which is several feet from the ground for greater visibility and impact, manual changing of the panels 10, as well as spacer panels 70, is undesirable, expensive, time consuming and dangerous.

Accordingly, and in order facilitate the changing of such panels as the letter-bearing panels 10, each panel is provided with an area of magnetically attractive material. Thus, it is contemplated that the panels 10 will be of a plastic material which is preferably resistant to weather, and that the letters, such as 12, will also be of a suitable weather resistant plastic, whereas the magnetically attractive material will preferably be ferrous in nature whereby to permit holding engagement between such material and a magnet such as 20. Other magnetically attractive materials may be used.

In the specific embodiment illustrated, the magnetically attractive material is on the front face 68 of the panel 10 and is in the form of a strip 86, which strip 86 is complementary to the periphery of the particular letter, character or other indicia carried on the front face 68 of the panel 10.

The strip 86 is contiguous with both the outer peripheral edge such as 88 of a letter such as A illustrated at 12 in FIG. 1 of the drawing, and is also contiguous with any inner edge, such as 90, which might be presented by a letter having the configuration of an A. Thus, the strip of magnetically attractive material 86 completely adjoins both the inner and outer edges of the letter, as illustrated, although it will be appreciated that the strip 86 could be positioned at other locations on the front face 68 of the panel 10. With spacer panels such as 70, the strip 86 is not used but rather such panels are handled by engaging the front face thereof with a suction cup 24, as is known, to install and remove such panels 70.

The indicia such as letters 12, is, as shown for instance in FIG. 3, of greater height than the strips 86 which circumscribe the letters 12. Also, the with or transverse dimension of the strip 86 of magnetically attractive material is substantially less than the width of the components of the letter 12, again, as illustrated in FIG. 3.

Since the strips 86 are spaced apart at least the width of the component of the letter which they circumscribe, the magnet 20 takes the form of a pair of spaced apart feet 92 and 94 whereby the magnet 20 may straddle the letter 12 to place the respective feet 92 and 94 into engagement with corresponding stretches of strip 86 as illustrated in FIG. 3 in connection with the movement of a panel 10 with respect to the front wall 36 of the readerboard.

Magnet 20 has a swivel connection as at 96 with arm 18 whereby the magnet 20 and therefore the feet 92 and 94 thereof may be relatively positioned to accommodate engagement with a letter or character of virtually any configuration. Likewise, the juxtaposition of handle 16 and the pole 26 carried thereby may be adjusted through locking swivel connection 98 to place the user 30 at an appropriate angle whereby to most readily gain access to the front wall 36 of the overhead readerboard 32 to position and remove panels therefrom. The length of pole 26 may be likewise be adjusted to accommodate the height and position of the user 30 with respect to the readerboard.

In utilizing the system of changeable sign letters as hereinabove described, it is best to follow the installation procedure for most efficiently utilizing the system, as follows. To install a message on the readerboard, the panels 10 bearing the desired letters, numbers and punctuation to create the message are organized on the ground and sufficient spacer panels may be placed on each end or between the message word or words to fill the length of the track within which the word or message is to be displayed.

Utilizing the magnet 20 through operating handle 16 by pole 26, the magnet 20 is brought into straddling engagement with a portion of stretch of the indicia, whereby the feet 92 and 94 may bear against a stretch of the strip 86 which is on each side of the portion of the letter straddled by magnet 20.

When such engagement occurs, the panel 10 may be lifted upwardly toward the readerboard and the upper edge 62 of the panel 10 initially slipped into channel 58 of rail 44. Holding the upper edge 62 of the panel 10 within channel 58, as illustrated in FIG. 3, the panel 10 is swung inwardly (to the left as viewing FIG. 3), whereby to place the rear face 66 of panel 10 in abutting engagement with the sheet 48 and particularly the outermost portion thereof, as illustrated in FIG. 2. By then twisting on the pole 26, the magnetic attraction between feet 92 and 94 and the strip 86 may be broken and the magnet 20 withdrawn from the panel 10, thereby permitting the panel 10 to slide downwardly under the influence of gravity. Alternatively, of course, the panel may be lowered into channel 60 manually through utilization of the handle 16.

Once the character panels have been installed as described, a suction cup 24 may be utilized to install spacer panels on each side of or between the letter-bearing panels, whereby to center the message 100 such as the word "OPEN" on the readerboard 32, as illustrated in FIG. 6. It will be appreciated that, because of the overlapping abutment between all of the panels within the full length of track 42, the only light passing through said stretch of panels will be that which is permitted through the translucent panels or the translucent portions 84 of the letters O, P, E and N.

To remove or change the message, the spacer panels may be engaged by suction cup 24, shifted upwardly into channel 58 and then swung outwardly and removed by pulling downwardly on the handle 16 by pole 26. Likewise, the letter-bearing panels may be removed by bringing feet 92 and 94 of magnet 20 into engagement with the spaced apart portions of strip 86 so that the magnet 20 will hold the panel 10 and thence moving the upper edge 62 of the panel 10 upward in channel 58, swinging the lower edge 64 of the panel 10 outwardly and thence pulling the panel down, as illustrated in FIG. 3. The panel may be then placed on the ground or in suitable storage means and retained for subsequent use.

Through utilization of the changeable letter sign system hereinabove described, an overhead readerboard message may be quickly, safely and economically created through the utilization of letter-bearing panels having magnetically attractive material thereon and a tool including a magnet for engaging such material and thereby holding the panel while the message is created on or removed from the readerboard.

What I claim is:

1. A changeable letter sign system comprising:

a readerboard for receiving a plurality of panels, each bearing a three dimensional, plastic letter thereon, said panels being combinable to collectively present a message displayed on the readerboard, said panels each having a normally front face and a normally rear face, the rear face being proximal to the readerboard when the panel is in place, the front face having the letter thereon and facing outwardly from said readerboard;

means for retaining said panels with respect to the readerboard; and magnetically attractive material carried by each of said panels, the magnetically attractive material being only on said front face providing a means for removing the panel from the readerboard.

2. A changeable letter sign system as set forth in claim 1, the magnetically attractive material presenting a sufficient surface area to permit a magnet to be placed in contact therewith.

3. A changeable letter sign system as set forth in claim 2, the attraction between the material and the magnet being sufficient to permit the magnet to remove the panel from the readerboard.

4. A changeable letter sign system as set forth in claim 3, the magnetically attractive material at least partially outlining the letter on the panel.

5. A changeable letter sign system as set forth in claim 4, the magnetically attractive material having a configuration complementary to the periphery of the letter on the panel.

6. A changeable letter sign system as set forth in claim 5, the magnetically attractive material being in the form of a strip of such material totally laid on the front face of the panel and completely outlining the letter on the panel.

7. A changeable letter sign system as set forth in claim 6, the strip of magnetically attractive material being contiguous with the peripheral inner and outer edges of the letter on the panel.

8. A changeable letter sign system as set forth in claim 7, the letter being of substantially greater height than the thickness of the strip.

9. A changeable letter sign system as set forth in claim 8, the transverse dimension of the letter being substantially greater than the transverse dimension of the strip of magnetically attractive material.

10. A changeable letter sign system as set forth in claim 9, the system including a magnet on a handle for engaging the magnetically attractive material to thereby hold the panel to the magnet so that the panel may be installed and removed by use of the handle with the magnet thereon.

11. A changeable, letter sign system as set forth in claim 10, the magnet having a pair of spaced feet, the spacing between the feet being sufficient to permit the magnet to straddle at least one dimension of the letter.

12. A changeable letter sign system as set forth in claim 11, the means for retaining the panels on the readerboard constituting a pair of spaced rails for respectively receiving opposite edges of the panel, the letter being readably positioned between said edges.

* * * * *